US012410626B2

(12) United States Patent
Geelen et al.

(10) Patent No.: US 12,410,626 B2
(45) Date of Patent: Sep. 9, 2025

(54) DEVICE FOR ALIGNING BUILDING BLOCKS AND METHOD

(71) Applicants: ADILANTI B.V., Landgraaf (NL); Antoon Laurens Gerard Marie Geelen, Roermond (NL)

(72) Inventors: Antoon Laurens Gerard Marie Geelen, Roermond (NL); Jozef Maria Hubertus Lemmens, Landgraaf (NL)

(73) Assignees: ADILANTI B.V., Landgraaf (NL); ANTOON LAURENS GERARD MARIE GEELEN, Roermond (NL)

( * ) Notice: Subject to any disclaimer, the term of this patent is extended or adjusted under 35 U.S.C. 154(b) by 0 days.

(21) Appl. No.: 17/907,940

(22) PCT Filed: Feb. 26, 2021

(86) PCT No.: PCT/NL2021/050131
§ 371 (c)(1),
(2) Date: Aug. 29, 2022

(87) PCT Pub. No.: WO2021/172993
PCT Pub. Date: Sep. 2, 2021

(65) Prior Publication Data

US 2023/0113232 A1 Apr. 13, 2023

(30) Foreign Application Priority Data

Feb. 29, 2020 (NL) ..... 2025024

(51) Int. Cl.
*E04G 21/18* (2006.01)

(52) U.S. Cl.
CPC ..... *E04G 21/1841* (2013.01)

(58) Field of Classification Search
CPC ..... E04G 21/1841; E04G 21/1808; E04G 21/18; E04F 13/0892
(Continued)

(56) References Cited

U.S. PATENT DOCUMENTS 3,173,187 A 3/1965 Pontiere
3,276,129 A * 10/1966 Andrews ..... E04G 21/1808 33/407
(Continued)

FOREIGN PATENT DOCUMENTS

CN 204252555 U 4/2015
DE 7110014 U 11/1971
(Continued)

OTHER PUBLICATIONS

Machine Translation of B. Armbruster. Nov. 18, 1971.*

*Primary Examiner* — Paola Agudelo
(74) *Attorney, Agent, or Firm* — Procopio, Cory, Hargreaves & Savitch LLP

(57) ABSTRACT

The invention relates to a device for aligning building blocks, comprising a connecting element and a base plate which is connected to one end of the connecting element, wherein the base plate extends from two opposite sides of the connecting element in a perpendicular manner or in an angle slightly less than perpendicular. The device further comprises a wedge receiving plate which is connected to the other end of the connecting element, is substantially in line with the connecting element and comprises an opening designed for receiving a wedge. The base plate and the wedge receiving plate are each connected to the connecting element via a frangible joint. Upon application of the device, the base plate, the wedge receiving plate and the wedge together squeeze the building blocks together so that they become aligned. As a last step, the base plate and the wedge receiving plate are broken off from the connecting element to leave the connecting element between the building blocks.

20 Claims, 5 Drawing Sheets

(58) Field of Classification Search
USPC ..... 52/126.1; 33/407, 408
See application file for complete search history.

(56) References Cited

U.S. PATENT DOCUMENTS

| | | | | | |
|---|---|---|---|---|---|
| 4,093,172 | A * | 6/1978 | Johnson | E04G 21/207 | 249/188 |
| 4,439,961 | A * | 4/1984 | Witte | E04G 21/26 | 52/169.8 |
| 5,129,151 | A * | 7/1992 | Kim | E04D 15/04 | 269/904 |
| 5,193,320 | A * | 3/1993 | Coccagna | E04G 21/1883 | 52/308 |
| 5,351,457 | A * | 10/1994 | Colen | E04B 2/10 | 52/564 |
| 5,722,176 | A * | 3/1998 | Hinson | E04G 21/1841 | 33/408 |
| 2007/0017107 | A1* | 1/2007 | Howell | E04G 21/1841 | 33/404 |
| 2008/0134605 | A1 | 6/2008 | Friesen et al. | | |
| 2008/0236094 | A1* | 10/2008 | Doda | E04F 21/22 | 52/749.11 |
| 2014/0298736 | A1* | 10/2014 | Bunch | E04F 21/0092 | 52/126.1 |
| 2020/0347617 | A1* | 11/2020 | Troxell | E04F 21/0092 | |
| 2021/0131124 | A1* | 5/2021 | Bunch | E04F 21/22 | |

FOREIGN PATENT DOCUMENTS

| | | | |
|---|---|---|---|
| EP | 2565346 | A1 | 3/2013 |
| WO | 92/14012 | A2 | 8/1992 |
| WO | 2008/118418 | A1 | 10/2008 |

* cited by examiner

DEVICE FOR ALIGNING BUILDING BLOCKS AND METHOD

CROSS-REFERENCE TO RELATED APPLICATIONS

This application is US National Stage of International Patent Application PCT/NL2021/050131, filed Feb. 26, 2021, which claims benefit of priority from Dutch Patent Application NL2025024, filed Feb. 29, 2020, the contents of both of which are incorporated herein by reference.

The present invention relates to a device for aligning building blocks and to a method for laying building blocks.

Walls that are composed of building blocks are usually built by placing rows of building blocks on top of one another. Common building blocks are made of stone, clay, sand-lime, glass or cellular concrete. In order to build a wall with a flat surface and having no curves, it is necessary that the building blocks are positioned in line, i.e. each building block has to be aligned with its neighbouring building blocks.

One conventional way of aligning is achieved by tightening an auxiliary string from one end of the wall to another end of the wall along the row of building blocks that is to be laid. Another conventional way makes use of a squeezing device that presses against neighbouring building blocks on opposite sides of the wall, as is e.g. described in U.S. Pat. No. 5,191,718A. In such case, part of the device is usually present between building blocks and thereby penetrates the emerging wall. External parts of the device that press against the building blocks protrude on either side of the wall. After finishing the wall, these external parts have to be removed since they spoil the wall's flat surface. A disadvantage of such device, however, is that removal of the external parts is difficult and often results in remnants that stick out of the wall. Another disadvantage of such devices is that accidental variations in the dimensions of the building blocks cannot be accommodated for.

It is therefore an object of the present invention to provide a device for aligning building blocks that does not suffer from one or more of these shortcomings.

Accordingly, the present invention relates to a device (1) for aligning building blocks, comprising

- a connecting element (2) having a first end (2*a*) and a second end (2*b*);
- a longitudinal axis (3) which extends from the first end (2*a*) of the connecting element (2) to the second end (2*b*) of the connecting element (2);
- a base plate (4) which is connected to the first end (2*a*) of the connecting element (2), wherein
  - the base plate (4) extends from two opposite sides of the connecting element (2); and
  - the angle of the base plate (4) with the connecting element (2) is the same on each of the two opposite sides, preferably the angle is 90° on each of the two opposite sides;
- a wedge receiving plate (5) which
  - is connected to the second end (2*b*) of the connecting element (2);
  - is in line with the longitudinal axis (3); and
  - comprises an opening (6) designed for receiving a wedge (7);
- wherein the base plate (4) and the wedge receiving plate (5) are each connected to the connecting element (2) via a frangible joint (8).

A device of the invention comprises two plates that are held together by a connecting element. Each end of the connecting element is connected to one of the plates. A longitudinal axis is present in the device, which is defined as a line that runs from one end of the connecting element to the other end of the connecting element.

One of the plates is a base plate which typically forms a T-shape with the connecting element. The other plate is a wedge receiving plate that is in line with the longitudinal axis. Accordingly, when a device of the invention is applied for aligning building blocks (e.g. in the manufacture of a wall), the longitudinal axis is automatically directed perpendicular to the plane of alignment of the building blocks (i.e. to both surfaces of the emerging wall). Such a device is displayed in FIG. 1.

The connecting element in a device of the invention preferably has a flat shape so that it fits between two building blocks. It is for example shaped as a strip, plate or disc. It may also have the shape of a bar or rod as long as the cross-section perpendicular to the elongate direction (i.e. perpendicular to the longitudinal axis) is still suitable for fitting between two blocks.

Figure 5:
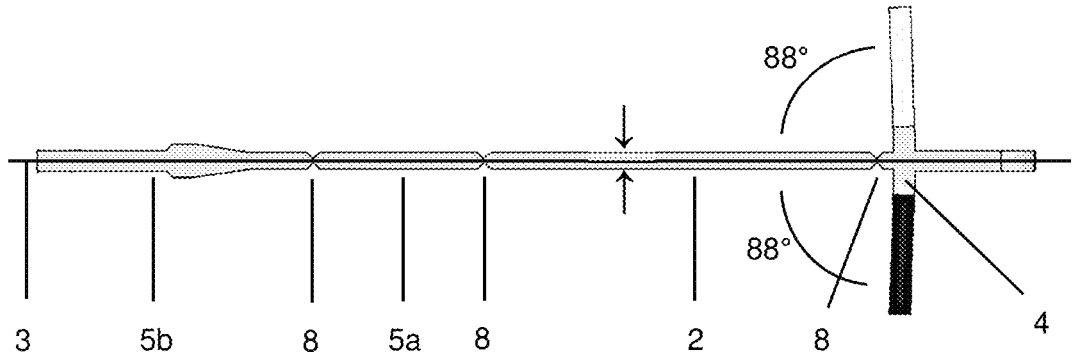
FIG. 5 is a side-view of a third device of the invention.

The thickness of the connecting element is preferably in the range of 0.5-5.0 mm, in particular in the range of 1.0-3.0 mm. By the thickness is in this case meant the smallest dimension of the cross-section perpendicular to the longitudinal axis. For example, in FIG. 5 the thickness of the connecting element (2) is indicated by the distance between the tips of the two opposing arrows.

The base plate is connected to the first end of the connecting element. The connection is typically made at the centre of the surface of the plate, so that the connecting element and the base plate together form a T-shape. In other words, the base plate extends from two opposite sides of the connecting element. When, for example, the connecting element is a strip wherein its two main surfaces form opposite sides, then the base plate extends from each of these sides.

Figure 1:
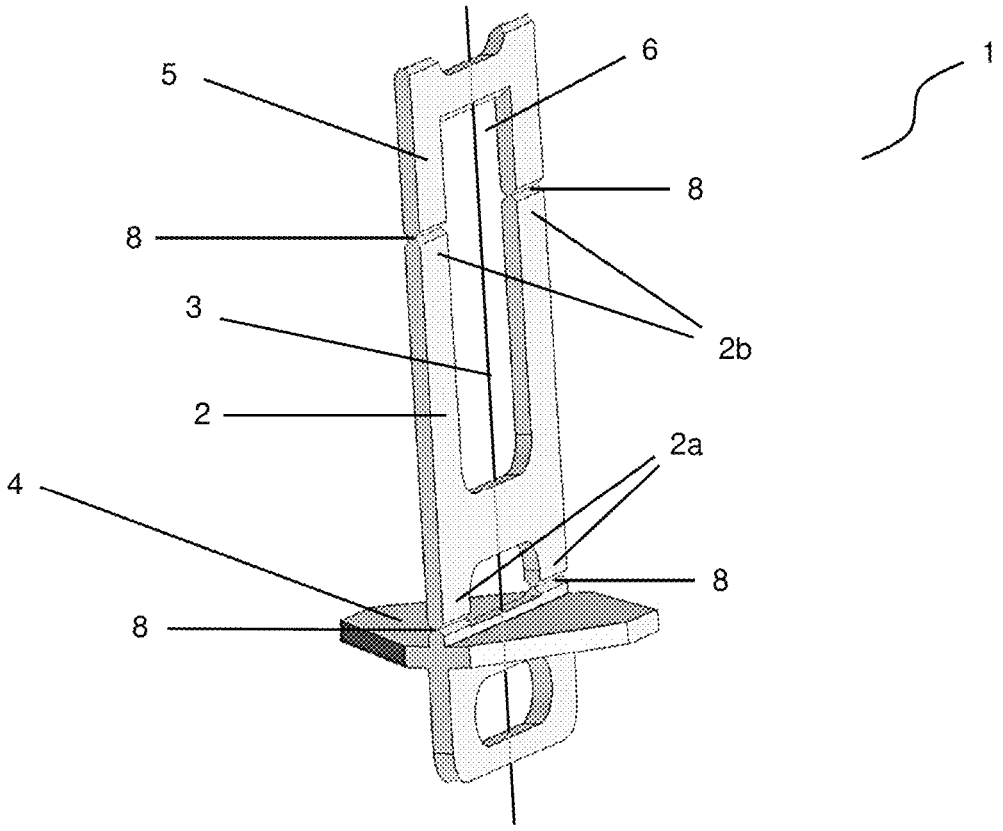
FIG. 1 is a perspective view of a first device of the invention.
Figure 2:
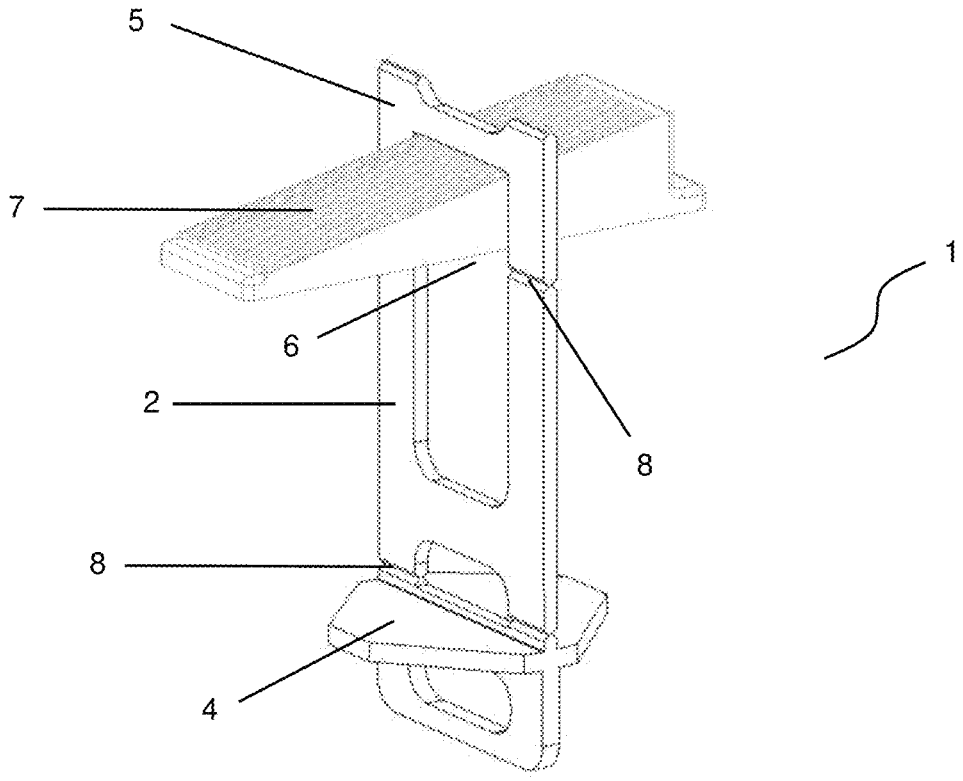
FIG. 2 is a perspective view of a first device of the invention comprising a wedge.
Figure 3:
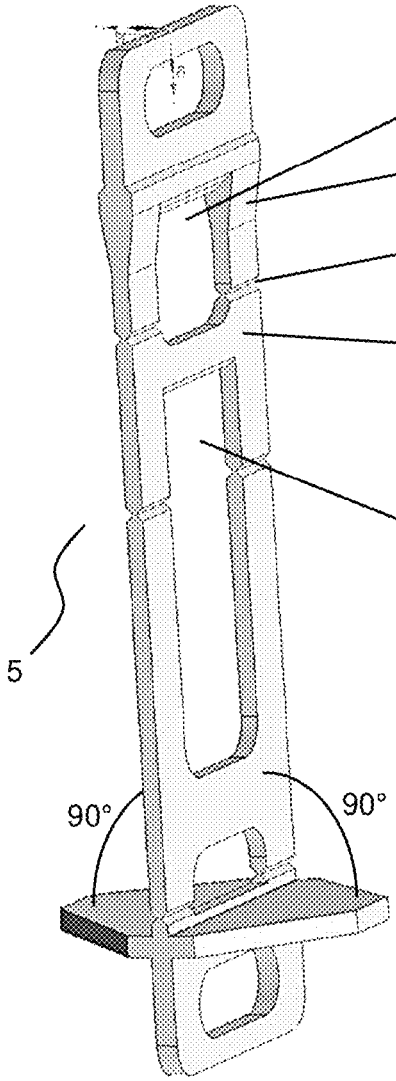
FIG. 3 is a perspective view of a second device of the invention.

The angle of the base plate with the connecting element is substantially the same on each of the two opposite sides. Typically, the angle is 90°, so that a T-shape is formed with perpendicular angles. The angle may also be less than 90°, so that the T-shape is more reminiscent of an arrow. In such cases, the base plate is bent at the connection with the connecting element. For example, the angle is in the range of 80°-89.9°, in particular in the range of 85°-89.5°. In the case of an angle that is not 90°, the base plate can be considered as consisting of two sections, one on either side of the bend. This is visualized in FIG. 5, which demonstrates a side-view of a device of the invention. The angle of the base plate with the connecting element is 88° on each of the two opposite sides. The same angles are also present in the device of FIG. 4, which is a perspective view of the device of FIG. 5. The respective angles in FIGS. 1-3 are all 90°.

The base plate is usually flat, but may also be curved. In particular, the two sections of the base plate that extend from the two opposite sides of the connecting element may be curved. In case a curve is present, the base plate is curved towards the connecting element. In this way, the building element touches the base plate only at the tips of the base plate, rather than at a flat surface of the base plate.

An advantage of an angle that is smaller than 90° and/or of a curved plate is that the building element touches the base plate only at the tips of the base plate so that irregularities at the surface of the building element can be better accommodated for. Also, when the material of the base plate is of an appropriate flexibility, it is easier to squeeze building blocks with a device of the invention and so align the building blocks.

The wedge receiving plate is connected to the other end of the connecting element. This plate is in fact an extension of the connecting element that can easily be broken off. The plate comprises an opening for receiving a wedge.

By a frangible joint (or frangible connection) between two members is meant that the joint (or connection) easily breaks upon the exertion of a force.

Such joint is designed to be frangible, i.e. it is designed to be the spot where failure occurs. In a device of the invention, the connecting element is frangibly connected with the base plate and the wedge receiving plate. When a force (typically a bending force) is exerted on the device over the frangible joint, then the breaking will occur at the frangible joint since it forms the weakest part.

As mentioned above, a frangible joint concerns the connection between two members, typically a connection between the connecting element and one of the two plates. Such frangible joint may however be composed of a plurality of frangible sub-joints when the connecting element comprises an economizing cut-out to spare material, and when a border of such cut-out coincides with the position of the frangible joint.

The distance between the two frangible joints is adapted to the width of the building blocks that are to be aligned with a device of the invention.

Building blocks of e.g. cellular concrete have a standard width of 5.0 cm, 7.0 cm or 10.0 cm. Therefore, the distance between the two frangible joints is preferably either in the range of 4.0-5.0 cm, in the range of 6.0-7.0 cm, in the range of 9.0-10.0 cm or in the range of 19.0-20.0 cm, more preferably either in the range of 4.2-4.8 cm, in the range of 6.2-6.8 cm, in the range of 9.2-9.8 cm, or in the range of 19.2-19.8 cm respectively. The end of the range coincides with the actual width of the building block, so that no part of the connecting element sticks out of the wall after breaking off the two frangible joints.

It is also possible that one particular device of the invention is suitable for the use with building blocks of different thicknesses. This may be accomplished by including in the device a plurality of openings that can receive a wedge. Each opening is then placed near a frangible joint. Such devices are displayed in FIGS. 3-5.

For example, an adaptation to two different thicknesses can be made in such device when the wedge receiving plate comprises two sections that are connected to each other via a frangible joint, each section comprising an opening designed for receiving a wedge. For example, the device is characterized in that the distance between the frangible joint of the connecting element with the base plate and the frangible joint of the connecting element with the wedge receiving plate is in the range of 6.0-7.0 cm, in particular in the range of 6.2-6.8 cm; and the distance between the frangible joint of the connecting element with the base plate and the frangible joint of the first section with the second section in the wedge receiving plate is in the range of 8.0-40.0 cm, in particular in the range of 9.0-10.0 cm, more in particular in the range of 9.2-9.8 cm.

An adaptation to three different thicknesses can be made when the wedge receiving plate comprises three subsequent sections that are connected via a frangible joint, each subsequent section comprising an opening designed for receiving a wedge. More generally, a device of the invention may comprise two or more subsequent sections that are connected via a frangible joint, each subsequent section comprising an opening designed for receiving a wedge.

Figure 4:
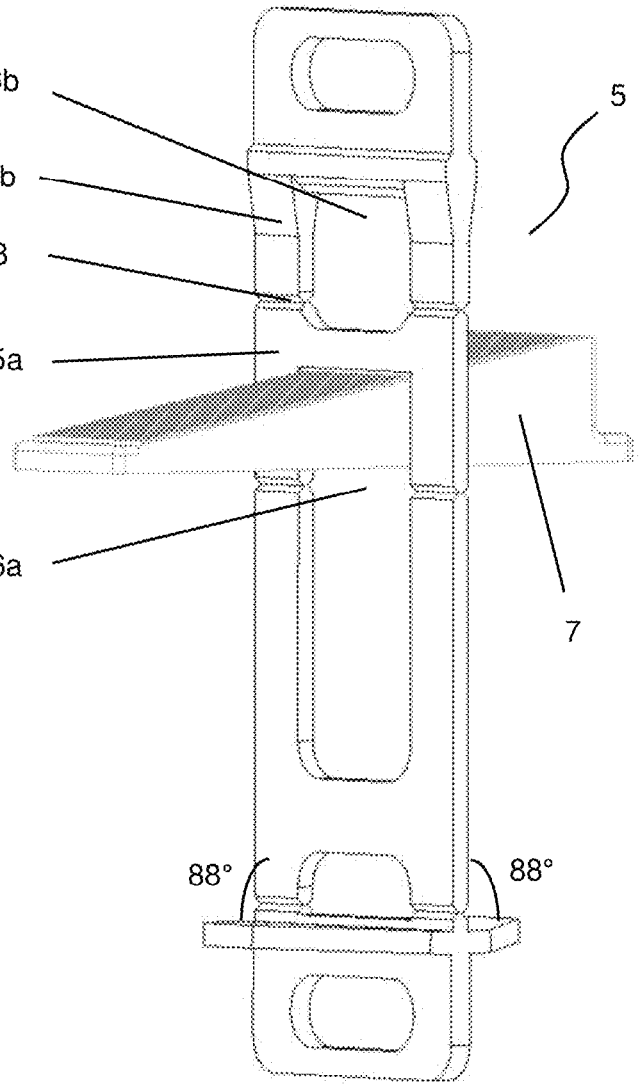
FIG. 4 is a perspective view of a third device of the invention comprising a wedge.

When a device of the invention is applied to align building blocks, it cooperates with a wedge. In such situation, the wedge is present in the opening of the wedge receiving plate, as is shown in FIGS. 2 and 4.

Preferably, the wedge has means to increase the friction with the device of the invention, in particular with the border of the opening in which the wedge is present, so that building blocks can actually be squeezed by the device of the invention. For example, the wedge has a corrugated or profiled surface.

The invention further relates to a method for laying building blocks, comprising

- providing
  - a first building block having a short side configured to abut a short side of another building block;
  - providing a second building block having a short side configured to abut a short side of another building block;
- then
- providing the short side of the first building block with a glue or mortar;
- placing a device according to any of claims 1-10 on the short side of the first building block so that the connecting element is projected on the building block and the base plate and the wedge receiving plate protrude on either side of the building block;
- then
- realizing a relative positioning of both building blocks wherein
  - the first building block abuts the second building block;
  - the short side of the first building block opposes the short side of the second building block so that the glue or mortar is in contact with both building blocks;
- sliding a wedge through the opening of the wedge receiving plate until both building blocks are squeezed between the base plate and the wedge receiving plate and so become aligned.

Figure 6:
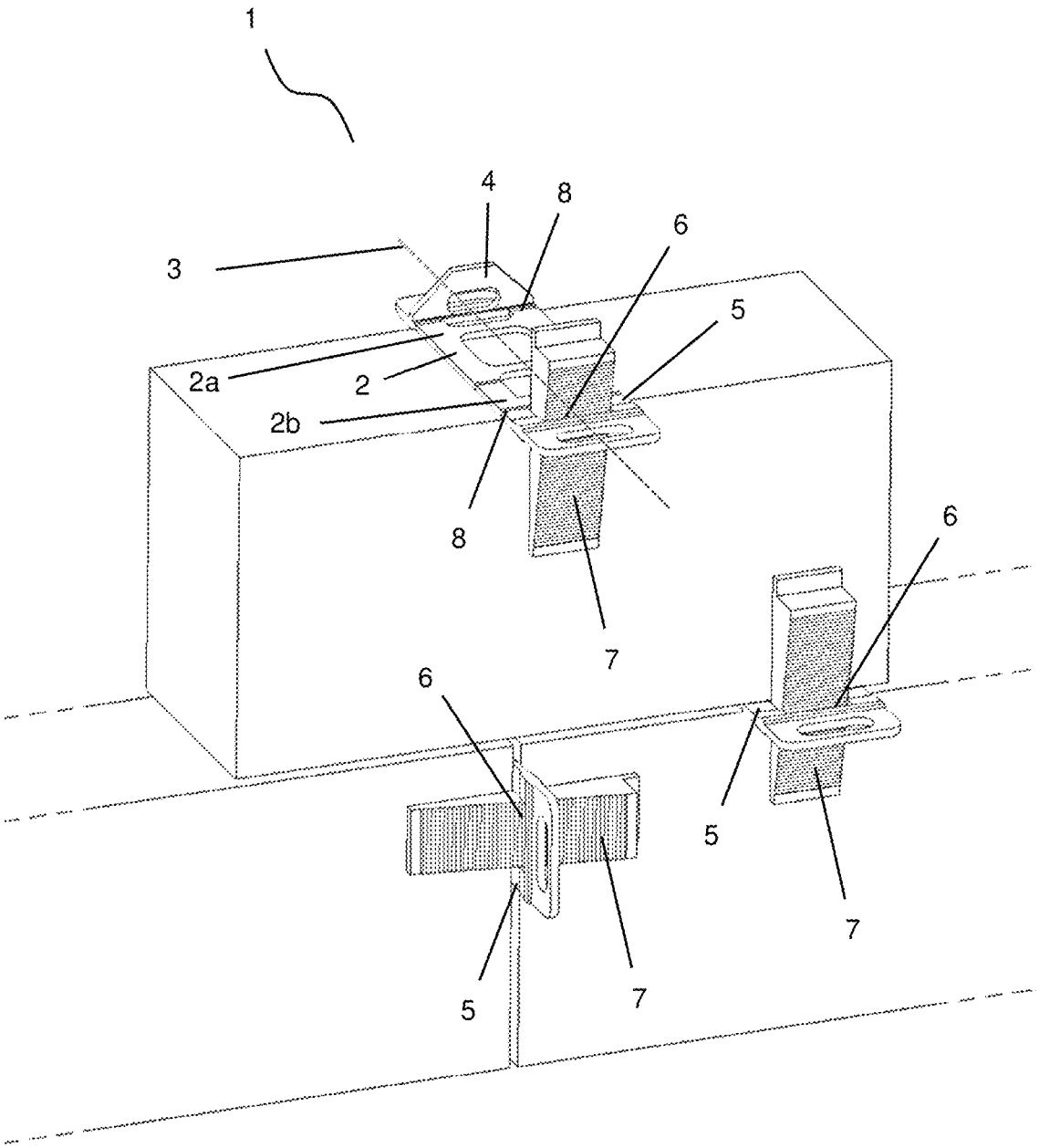
FIG. 6 is a perspective view of neighbouring building blocks comprising devices of the invention.

FIG. 6 displays a few building blocks that have been laid according to this method. The devices of the invention are (at least partly) present in between the building blocks. In particular, their connection elements are completely enclosed by neighbouring building blocks, while the base plates and the wedges reside at the surface of the building blocks and so ensure that the building blocks become and stay aligned.

The building blocks used in a method of the invention may in principle be of any solid material. Usually, they are made of a material selected from the group of stone, clay, sand-lime, glass or cellular concrete.

The latter term is also known under the names of foamed concrete, aerated concrete, occluded air cement and porous concrete.

In a method of the invention, the building blocks may contain recesses that accommodate the connecting elements. This may be performed when the distance between two building blocks needs to be smaller than the thickness of the building blocks. Usually, however, it is also possible to just choose a device with a connection element of an appropriate thickness, i.e. a thickness that is smaller than the desired distance between the building blocks.

For the laying of the building blocks, it is preferred to make use of a glue (e.g. polyurethane) or mortar. This may be placed between the building blocks so as to increase the mutual adherence of the building blocks. The device of the invention, in particular the connecting element, is then surrounded by the glue or mortar.

Usually, the method of the invention is followed by removing the base plate and the wedge receiving plate by breaking their frangible joints with the connecting element to leave the connecting element behind between the two building blocks. This is because the plates and the wedge spoil the flat surface of e.g. the wall that has been built. The removal may be performed manually or with the use of a tool such as a hammer and/or a pair of pliers.

It is not necessary that a device of the invention also acts as a spacer between two building blocks, i.e. it is not used to ensure that a constant spacing between two building blocks is generated during laying of the building blocks. Thus, at the location of a device of the invention, not the entire spacing between two building blocks is occupied by the connecting element.

For example, the distance between to building blocks is for less than 90% occupied by the connecting element, in particular for less than 50%.

The present invention further relates to a wall obtained by a method as described above.

The invention further relates to a wall that is composed of building blocks, wherein one or more connector elements are present between two neighbouring building blocks, any side of the one or more connector elements being receded from the surface of the wall over a distance of at least 0.1 cm. The invention further relates to a kit comprising a device a described above and a wedge that is adapted to be received in the opening of the wedge receiving plate. Such kit may further comprise a hammer and/or a pair of pliers.

Figure 7:
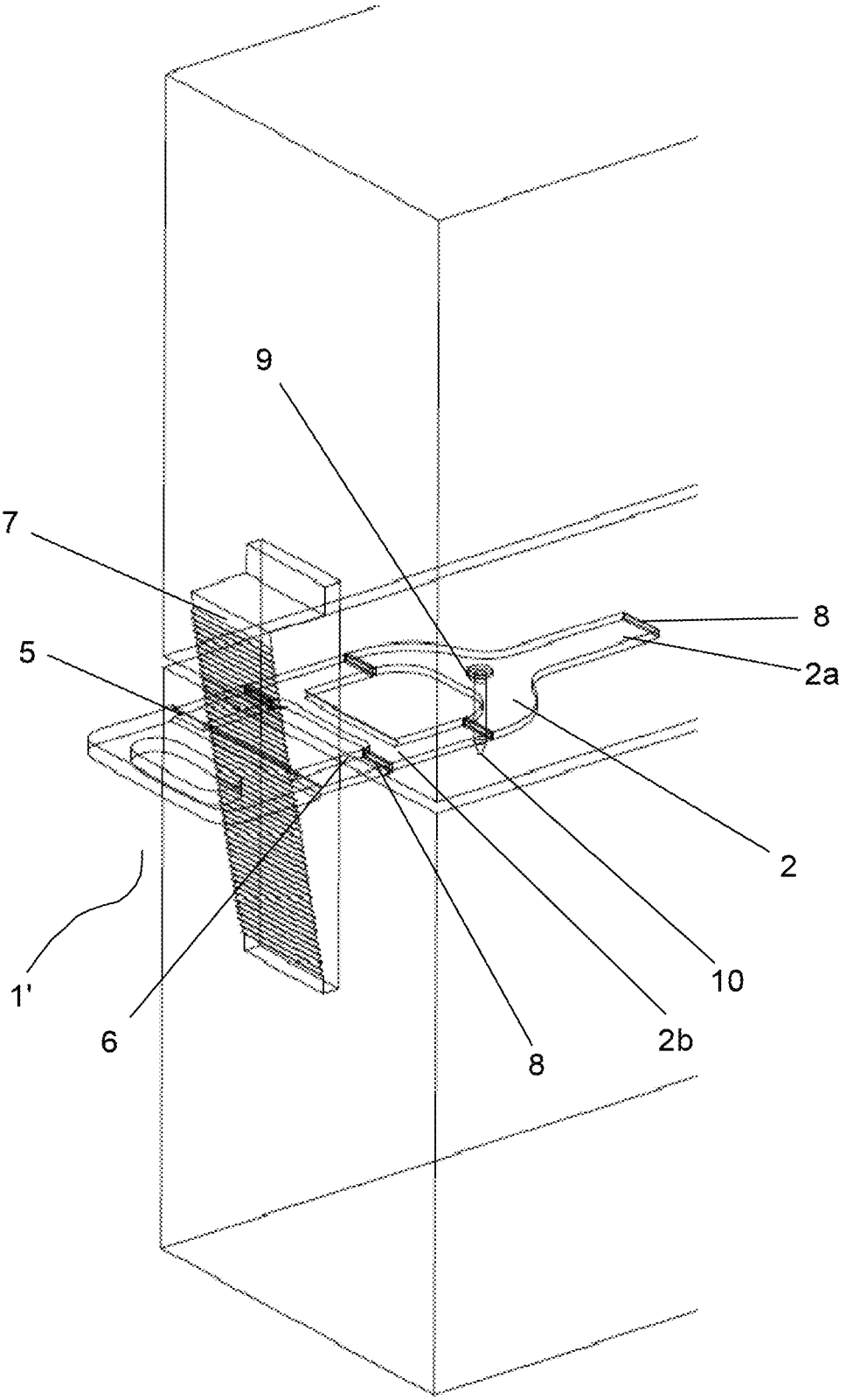
FIG. 7 is a perspective view of a further embodiment of a device of the invention.

FIG. 7 shows another embodiment of a device 1' according to the invention, in part similar to the example depicted in FIGS. 1 and 2. The connecting element (2) is provided with a through opening (9) near the first end (2*a*) thereof, and near the base plate (4). The through opening (9) serve for alignment of the header faces of building blocks of e.g. cellular concrete. To this end, the base plate (4) is removed (broken away) from the connecting element (2) by the exertion of a force on the frangible joint (8) between the first end (2*a*) and the base plate (4).

The connecting element (2), thus without the base plate (4) as the latter is now broken away, is to be placed on a building block with the second end (2*b*) passed the header face thereof. In particular the frangible joint (8) between the second end (2*b*) and the wedge receiving plate (5) should be aligned with the header face of the building block.

By driving a nail (10) through the through opening (9) into the building block, the connecting element (2) is properly positioned in a fixed manner relative to the header face. Next, a further building block is placed onto the first building block with its header face being flush with the header face of the first building block.

Subsequently, a wedge (7) is placed in the opening (6) of the wedge receiving plate (5) for aligning both header faces of the building blocks placed on top of each other. As the nail (10) placed in the through opening (9) serves as an anchor for the connecting element (2), a suitable alignment force can be exerted by the wedge (7) on both header faces, thus ascertaining a proper alignment.

At a later stage, the wedge (7) and the wedge receiving plate (5) are removed, the latter by breaking the frangible joint (8) with the second end (2*b*) of the connecting element (2), thereby leaving the connecting element (2) and the nail (10) in the through opening (9) behind between the two now aligned building blocks. This is because the wedge spoils the flat header surfaces of e.g. the wall that has been built. The removal may be performed manually or with the use of a tool such as a hammer and/or a pair of pliers.

Figure 8:
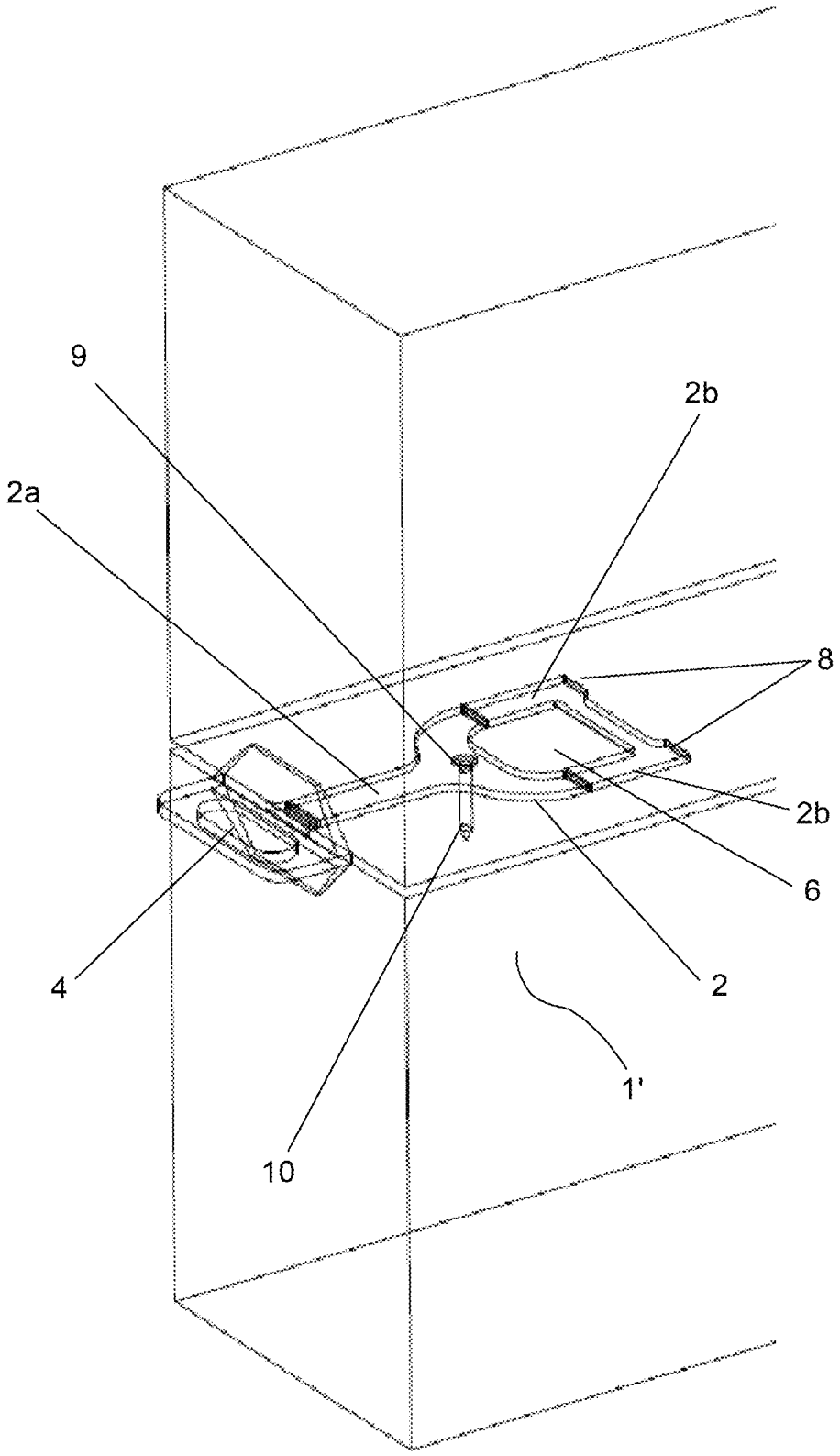
FIG. 8 is a perspective view of yet a further embodiment of a device of the invention.

Alternatively, as depicted in FIG. 8, the connecting element (2) is turned and placed with the base plate (4) in an abutment position against the flat header surface of a building block with the wedge receiving plate (5) being removed by breaking the frangible joint (8) with the second end (2*b*). Subsequently, a further building block is placed onto that first building block with its header face in abutment with the base plate (4) and consequently being flush with the header face of the first building block. Also in this example the connecting element (2) and the nail (10) in the through opening (9) remain behind between the two now aligned building blocks, whereas the base plate (4) is removed by breaking the frangible joint (8) with the first end (2*a*).

The invention claimed is:

1. Device for aligning building blocks with their neighboring building blocks for building a wall with a flat surface, the device comprising a connecting element having a first end and a second end;

a longitudinal axis which extends from the first end of the connecting element to the second end of the connecting element;

a base plate which is connected to the first end of the connecting element, wherein the base plate extends from two opposite sides of the connecting element; and an angle of the base plate with the connecting element is essentially the same on each of the two opposite sides; and a wedge receiving plate which:

is connected to the second end of the connecting element;

is substantially in line with the longitudinal axis; and comprises an opening designed for receiving a wedge, wherein the base plate and the wedge receiving plate are each connected to the connecting element via a frangible joint, wherein the angle of the base plate with the connecting element is 90° on each of the two opposite sides of the connecting element, or lower than 90° so that the base plate has a bend at the connection with the connecting element, and wherein the frangible joint intersects the opening of the wedge receiving plate.

2. Device according to claim 1, wherein the connecting element has a shape of a strip, a plate, or a disc.

3. Device according to claim 1, wherein a smallest dimension of a cross-section of the connecting element perpendicular to the longitudinal axis has a thickness in range of 0.5 mm-5.0 m.

4. Device according to claim 3, wherein the thickness in a range from 1.0 mm to 3.0 mm.

5. Device according to claim 1, wherein the frangible joint of the connecting element with the base plate; and the frangible joint of the connecting element with the wedge receiving plate are separated by a distance in a range of 4.0 cm-5.0 cm, in a range of 6.0 cm-7.0 cm, in a range of 9.0 cm-10.0, cm or in a range of 19.0 cm-20.0 cm.

6. Device according to claim 1, wherein the wedge receiving plate comprises a first section and a second section that are connected via a frangible joint, each section comprising an opening designed for receiving a wedge.

7. Device according to claim 6, wherein a distance between the frangible joint of the connecting element with the base plate and the frangible joint of the connecting element with the wedge receiving plate is in a range of 6.0 cm-7.0 cm, and a distance between the frangible joint of the connecting element with the base plate and the frangible joint of the first section with the second section in the wedge receiving plate is in a range of 8.0 cm-40.0 cm.

8. Device according to claim 7, wherein the distance between the frangible joint of the connecting element with the base plate and the frangible joint of the first section with the second section in the wedge receiving plate is in the range from 9.0 cm to 10.0 cm.

9. Device according to claim 1, wherein the base plate is curved towards the connecting element.

10. Device according to claim 1, wherein near the first end thereof, the connecting element is provided with a through opening.

11. Device according to claim 1, further comprising a wedge that is present in the opening of the wedge receiving plate.

12. Device according to claim 11, wherein the wedge has a corrugated or profiled surface to increase grip with the device.

13. Device according to claim 1, wherein the angle is in a range from 85° to 89.5°.

14. Wall that is composed of building blocks, wherein one or more connector elements including the connector element of claim 1 are present between two neighboring building blocks, any side of the one or more connector elements being receded from the surface of the wall over a distance of at least 0.1 cm.

15. Kit comprising a device according claim 1, and a wedge that is adapted to be received in the opening of the wedge receiving plate.

16. Kit according to claim 15, further comprising a hammer and/or a pair of pliers.

17. Method for laying building blocks, the method comprising providing a first building block having a short side configured to abut a short side of another building block;

providing a second building block having a short side configured to abut a short side of another building block;

then providing the short side of the first building block with a glue or mortar;

placing a device according to claim 1 on the short side of the first building block so that the connecting element is projected on the building block and the base plate and the wedge receiving plate protrude on either side of the building block;

then realizing a relative positioning of both building blocks, wherein:

the first building block abuts the second building block;

the short side of the first building block opposes the short side of the second building block so that the glue or mortar is in contact with both building blocks; and sliding a wedge through the opening of the wedge receiving plate until both building blocks are squeezed between the base plate and the wedge receiving plate and so become aligned.

18. Method according to claim 17, which method is followed by removing the base plate and the wedge receiving plate by breaking their frangible joints with the connecting element to leave the connecting element behind between the two building blocks.

19. Method according to claim 18, wherein a distance between the building blocks is for less than 90% occupied by the connecting element.

20. Method according to claim 19, wherein the distance between the building blocks is for less than 50% occupied by the connecting element.

* * * * *